United States Patent [19]

Wochnowski

[11] 4,037,712

[45] July 26, 1977

[54] METHOD AND APPARATUS FOR SUPPLYING TOBACCO TO TOBACCO CUTTING MACHINES

[75] Inventor: Waldemar Wochnowski, Hamburg, Germany

[73] Assignee: Hauni-Werke Korber & Co., KG, Hamburg, Germany

[21] Appl. No.: 653,737

[22] Filed: Jan. 30, 1976

[30] Foreign Application Priority Data

Feb. 6, 1975 Germany ..... 2504902

[51] Int. Cl.[2] ..... B65G 43/08

[52] U.S. Cl. ..... 198/524; 198/569; 198/572; 198/855; 131/135; 241/34; 198/358

[58] Field of Search ..... 198/37, 39, 524, 347, 198/358, 504, 505, 569, 572, 810, 855; 131/135, 21 A; 241/34

[56] References Cited

U.S. PATENT DOCUMENTS

| | | | |
|---|---|---|---|
| 1,501,622 | 7/1924 | Ruau | 198/37 |
| 2,381,505 | 8/1945 | Lindholm | 198/37 X |
| 2,708,503 | 5/1955 | Arnold | 198/37 |
| 2,737,997 | 3/1956 | Himmelheber et al. | 198/37 X |
| 2,966,253 | 12/1960 | Gerrans | 198/37 |
| 3,419,015 | 12/1968 | Wochnowski | 131/135 X |
| 3,709,274 | 1/1973 | Marek et al. | 241/223 X |
| 3,709,351 | 1/1973 | Oldershaw et al. | 198/37 |
| 3,794,049 | 2/1974 | Wochnowski | 198/39 X |

FOREIGN PATENT DOCUMENTS

| | | | |
|---|---|---|---|
| 1,551,909 | 7/1969 | Germany | 198/37 |

*Primary Examiner*—Evon C. Blunk
*Assistant Examiner*—Richard K. Thomson
*Attorney, Agent, or Firm*—Peter K. Kontler; John Kurucz

[57] ABSTRACT

The moving parts of a tobacco cutting machine and the conveyor or conveyors which transfer tobacco to the cutting machine are driven by a variable speed motor whose speed is regulated in dependency on the volume of tobacco in a duct from which the conveyor or conveyors draw or receive tobacco for transfer into the machine. The height of the pile of tobacco in the duct is monitored by photoelectric cells which transmit signals to a speed regulator for the motor so that the speed of the motor increases and decreases when the height of the pile respectively increases and decreases. The duct receives tobacco at a constant rate from a metering unit. Fluctuations of the height of tobacco pile in the duct are due to changes in size, moisture content and/or temperature of tobacco which is being supplied by the metering unit. The latter can supply tobacco to the ducts of two or more discrete cutting machines and then includes a distributor which feeds tobacco to all ducts at an equal rate. The outlets of the ducts are sealable by gates which close in response to stoppage of the respective motors. The remaining duct or ducts then receive tobacco at a higher rate which, in turn, results in acceleration of the respective motor or motors.

15 Claims, 4 Drawing Figures

Fig.1
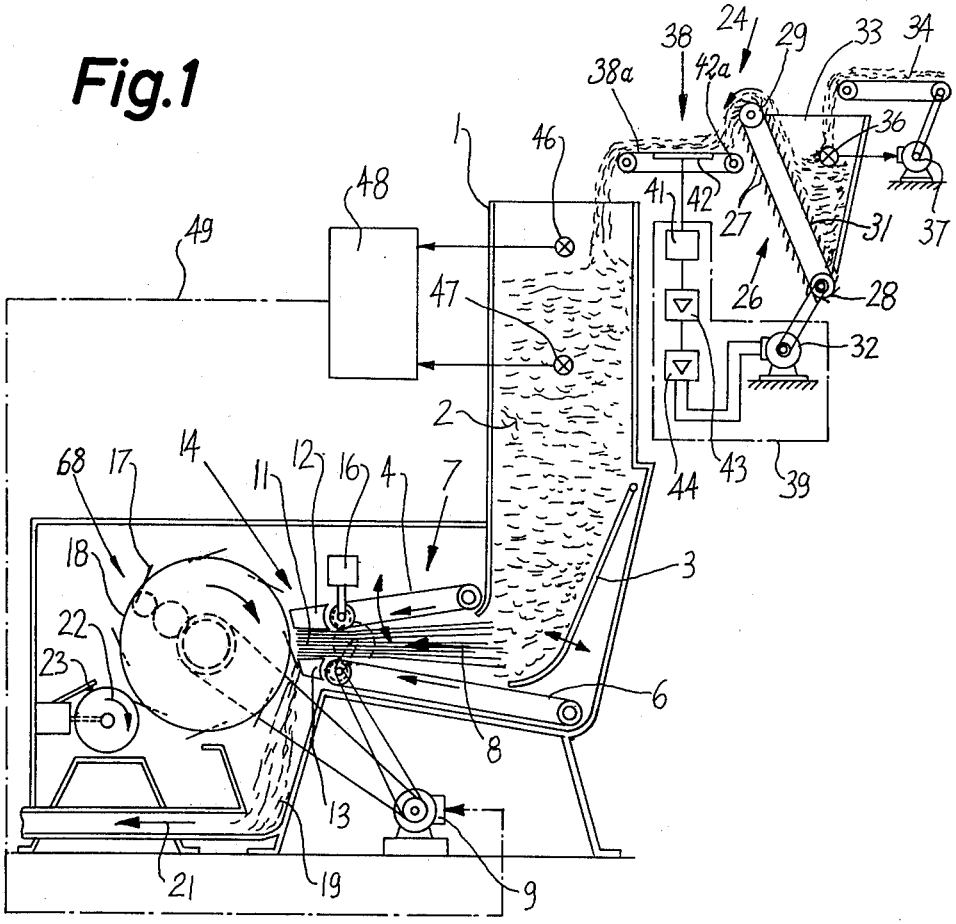
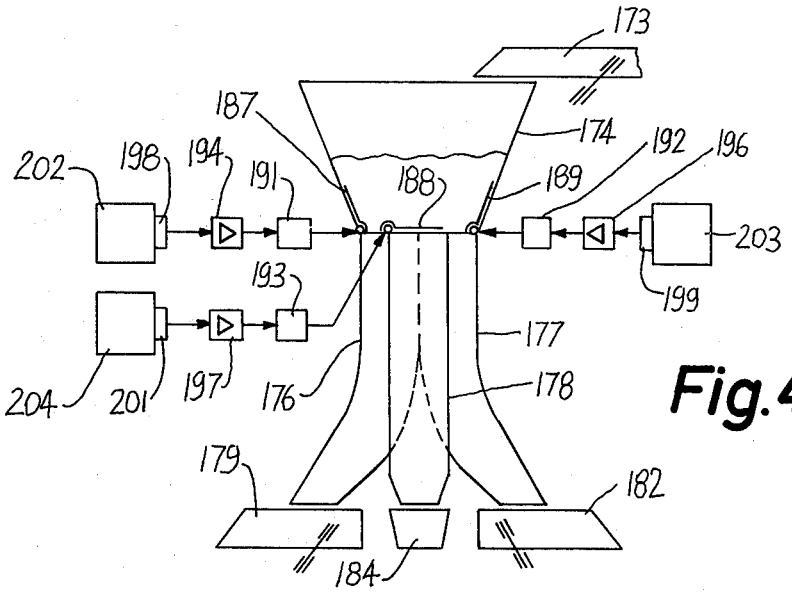
Fig.4

METHOD AND APPARATUS FOR SUPPLYING TOBACCO TO TOBACCO CUTTING MACHINES

BACKGROUND OF THE INVENTION

The present invention relates to a method and apparatus for supplying tobacco to tobacco cutting machines. More particularly, the invention relates to improvements in a method and apparatus for supplying tobacco to one or more cutting machines which can be operated at a plurality of speeds, i.e., whose output is variable to insure that the rate of comminution is proportional to the rate of tobacco feed.

The commonly owned U.S. Pat. No. 3,801,024 to Elsner discloses an apparatus for comminuting tobacco wherein the tobacco compacting or condensing chains of the cutting machine (e.g., a shredding machine) receive tobacco from a container. Such machines can be used as a means for comminuting tobacco leaf laminae, tobacco ribs or reconstituted tobacco. As a rule, the moisture content of comminuted tobacco which issues from a cutting machine is much too high for immediate processing of such tobacco in a cigarette making or like machine. This is due to the fact that a modern high-speed cutting machine cannot properly comminute tobacco having a relatively low moisture content. Consequently, tobacco which is about to be comminuted must be moisturized and tobacco fragments (e.g., shreds) issuing from the cutting machine must be dried to reduce their moisture content. The drying of tobacco shreds must be carried out with a very high degree of accuracy because the moisture content of tobacco shreds in a modern cigarette maker must match a predetermined moisture content or can deviate from such predetermined moisture content by a small fraction of 1 percent. Therefore, a dryer which receives tobacco shreds from a cutting machine is a complex and expensive apparatus wherein the shreds remain for a relatively long interval of time in order to insure that the moisture content of each and every portion of the continuous tobacco stream issuing from the cutting machine equals or closely approximates the desired moisture content. The complexity of dryers for tobacco shreds is attributable primarily to two unpredictable parameters, namely the moisture content of shreds and the mass or quantity of tobacco issuing from the cutting machine. Fluctuations of the moisture content are due to a variety of reasons and, since the final moisture content is of utmost importance, the dryers are invariably designed to eliminate such fluctuations before the shreds are permitted to enter the distributor of a cigarette maker. Fluctuations in the quantity of tobacco issuing from the cutting machine (or from a battery of two or more parallel cutting machines) are also due to a host of factors, including the density of tobacco cake which is fed into the range of the moving knife or knives of a cutting machine, the temperature of tobacco to be comminuted, the moisture content of tobacco to be comminuted and the size of tobacco particles which are to be converted into a cake. It will be appreciated that the construction and operation of aforementioned dryers between the cutting machine or machines and a cigarette maker can be simplified and their output increased if the dryers must be designed exclusively for the purpose of reducing the moisture content, i.e., if such dryers receive tobacco shreds at a constant or nearly constant rate.

Heretofore known methods and apparatus for insuring that the dryers for tobacco shreds receive constant or substantially constant quantities of tobacco per unit of time have met with limited success, either because the apparatus are too complex and expensive or because they are incapable of insuring the delivery of constant quantities of tobacco so that the dryers which receive tobacco from such apparatus must be designed to compensate for fluctuations of moisture content as well as for fluctuations of the rate of tobacco delivery thereto.

SUMMARY OF THE INVENTION

An object of the invention is to provide a novel and improved method of supplying tobacco to one or more cutting machines in such a way that the quantity of comminuted tobacco issuing from such machines varies very little or not at all.

Another object of the invention is to provide a method of supplying tobacco to one or more cutting stations in such a way that the weight of comminuted tobacco which leaves the station or stations per unit of time remains at least substantially constant.

A further object of the invention is to provide a novel and improved apparatus for supplying tobacco to and for regulating the speed of a cutting machine in such a way that the output of the machine remains constant irrespective of eventual fluctuations in the temperature, moisture content and/or size of tobacco which is being fed to the cutting machine.

An additional object of the invention is to provide a single cutting machine or a battery of two or more cutting machines which can supply comminuted tobacco to one or more dryers in such a way that the dryer or dryers invariably receive equal quantities of comminuted tobacco per unit of time, especially equal amounts per weight, so that the construction and operation of the dryers can be simplified because they need not be designed to compensate for fluctuations in the rate of tobacco delivery but solely with a view to change the moisture content of comminuted tobacco to a predetermined value.

Still another object of the invention is to provide a novel and improved metering unit which can be used to supply tobacco leaves, ribs, leaf laminae or reconstituted tobacco to one or more cutting machines.

One feature of the invention resides in the provision of a method of supplying tobacco (e.g., tobacco leaf laminae) to at least one cutting station in a tobacco cutting machine (e.g., a shredding machine) wherein tobacco is comminuted at the rate at which it enters the cutting station. The method comprises the steps of transporting a continuous stream of tobacco at a substantially constant rate along a predetermined path (e.g., by resorting to a suitable metering unit which includes a weighing device), accumulating the tobacco of such stream ahead of the cutting station so that the thus accumulated tobacco forms an intermediate supply (preferably an upright column or pile of tobacco leaf laminae), transferring tobacco from the supply to the cutting station at a variable rate, monitoring the volume of tobacco in the supply, and respectively increasing and reducing the rate of tobacco transfer from the supply to the cutting station when the volume of tobacco forming the supply respectively increases and decreases so that the rate at which tobacco reaching the cutting station is comminuted varies as a function of changes in the volume of tobacco forming the supply. This insures that the volume of tobacco in the supply remains constant or fluctuates only within a permissible predetermined range.

If the tobacco forming the intermediate supply constitutes an upright pile or column, the step of respectively increasing and reducing the rate of tobacco transfer to the cutting station preferably comprises increasing the rate of tobacco transfer when the height of the pile reaches a predetermined upper level and reducing the rate of tobacco transfer when the height of the pile reaches a predetermined lower level. The tobacco is transferred at a substantially constant rate as long as the height of the pile remains between the upper and lower levels.

The improved method may be practiced with apparatus which supply tobacco to a single cutting station or with apparatus which supply tobacco to a first station and to at least one additional cutting station wherein tobacco is comminuted at the rate at which it enters the additional station. The method then further comprises the steps of transporting an additional continuous stream of tobacco at a substantially constant rate along an additional predetermined path, accumulating the tobacco of the additional stream ahead of the additional cutting station to form an additional intermediate supply, transferring tobacco from the additional supply to the additional station at a variable rate, monitoring the volume of tobacco in the additional supply, and respectively increasing and reducing the rate of tobacco transfer from the additional supply to the additional cutting station when the volume of tobacco forming the additional supply respectively increases and decreases so that the rate at which tobacco reaching the additional station is comminuted varies as a function of changes in the volume of tobacco forming the additional supply.

The just described method may further include the steps of interrupting the comminuting of tobacco at the additional cutting station (e.g., due to a malfunction of the respective cutting machine), simultaneously interrupting the transfer of tobacco to the additional supply and from the additional supply to the additional cutting station, transporting the additional stream of tobacco to the first mentioned intermediate supply whereby the volume of tobacco forming the first mentioned supply increases, and increasing the rate of tobacco transfer from the first mentioned supply to the first mentioned cutting station as a result of such increase in the volume of tobacco forming the first mentioned supply.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 1 is a schematic partly elevational and partly sectional view of an apparatus which embodies one form of the invention and serves to supply tobacco to a single cutting machine;

FIG. 4 is a sectional view as seen in the direction of arrows from the line IV—IV of FIG. 3.

DESCRIPTION OF THE PREFERRED EMBODIMENTS

Figure 2:
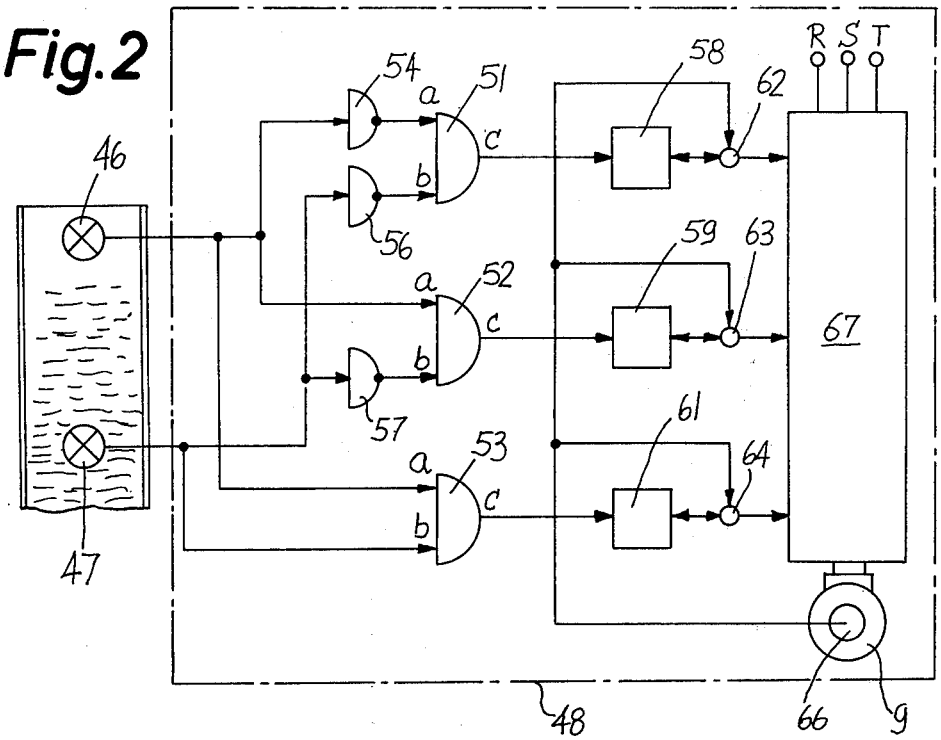
FIG. 2 is a circuit diagram of the speed regulating means in the apparatus of FIG. 1.

Referring first to FIG. 1, there is shown a cutting or shredding machine 68 which receives tobacco from an upright container or duct 1 for an intermediate supply or pile of tobacco 2. The supply is assumed to consist of tobacco leaf laminae which can be comminuted to yield tobacco shreds. The lower portion of the duct 1 contains a rake 3 which is pivotable about a fixed axis and is adjacent to the rear wall of the duct. The rake 3 is pivoted at predetermined (but preferably variable) intervals so as to feed tobacco into a converging channel which is defined by the lower stretch of an upper endless chain 4 and the upper stretch of a lower endless chain 6. The chains 4, 6 are driven to move in the directions indicated by arrows and serve to convert loose tobacco leaves into a compact cake 11. These chains together constitute a transfer device 7 which delivers tobacco to a cutting station of the machine 68. The direction in which the cake 11 advances toward the cutting station is indicated by arrow 8. The means for driving the chains 4 and 6 comprises a variable-speed prime mover 9, preferably a DC-motor. The front end of the cake 11 passes between the upper and lower sections 12, 13 of a mouthpiece 14 and into the range of orbiting knives 17 mounted at the periphery of a rotary drum-shaped carrier 18 which is driven by the variable-speed motor 9. The left-hand sprocket wheel for the upper endless chain 4 is urged downwardly by a suitable biasing device 16, e.g., a fluid-operated cylinder and piston unit. The lower section 13 of the mouthpiece 14 constitutes a counterknife for the orbiting knives 17 of the carrier 18. When the motor 9 is on, the knives 17 remove from the front-end of the cake 11 a plurality of tobacco shreds 19 which descend into the lower portion of the cutting machines 68 and are evacuated in the direction indicated by arrow 21.

The cutting machine 68 further comprises a grinding wheel 22 for the orbiting knives 17 and a dressing tool 23 (e.g. a diamond) for the grinding wheel.

The apparatus for supplying tobacco 2 to the cutting machine 68 comprises the aforementioned duct 1 and transfer unit 7 and a metering unit 24 which supplies to the duct a continuous stream of tobacco leaf laminae. The metering unit 24 comprises a continuously driven adjustable feeder 26 which can be operated at a plurality of speeds and includes a carded belt 31 trained over pulleys 28, 29 and having a plurality of pins or analogous projections 27 which draw tobacco from the interior of a bin 33. The means for driving the lower pulley 28 of the feeder 26 comprises a variable-speed prime mover 32, preferably a DC-motor. The right-hand stretch of the carded belt 31 constitutes a mobile wall of the bin 33.

The means for delivering tobacco to the bin 33 comprises an intermittently driven supply conveyor 34. The volume of tobacco in the bin 33 is monitored by a detector 36, e.g. a photoelectric cell, which starts or arrests an electric motor 37 serving to drive the supply conveyor 34. The detector 36 insures that the level of the upper surface of the mass of tobacco in the bin 33 fluctuates very little or not at all.

The carded belt 31 delivers tobacco onto the upper reach of an endless belt **38*a* forming part of a weighing device 38 in the metering unit 24**. The weighing device 38 transmits signals to a control circuit 39 which regulates the speed of the motor 32 for the lower pulley 28 of the feeder 26. The belt 38*a* is mounted on a weigh-beam 42 which is pivotable at 42*a* and is operatively connected with a transducer 41 of the control circuit 39. Signals at the output of the transducer 41 are indicative of the weight of successive increments of the tobacco stream which travels with the upper reach of the belt 38*a*. Such signals are transmitted to a preamplifier 43 and thereupon to a second amplifier 44 which directly controls the motor 32. The amplifier 44 is preferably a thyristorized amplifier with a DC output. Such amplifiers are known; a suitable amplifier is sold by the West-German firm AEG under the name "MINISEMI".

The means for monitoring the volume of tobacco 2 in the duct 1 comprises two detectors 46, 47 (preferably photoelectric cells each having a light source in line with a photosensitive receiver) which transmit signals to a speed regulating means or regulator 48 connected to the variable-speed electric motor 9 for the chains 4, 6 and carrier 18. The operative connection between the speed regulator 48 and the motor 9 is indicated by a phantom line 49. The detector 46 is an upper level indicator, and the detector 47 is a lower level indicator. The purpose of the speed regulator 48 is to increase the speed of the motor 9 when the volume of tobacco 2 in the duct increases and to reduce the speed of the motor 9 when the volume of tobacco in the duct 1 decreases. The cutting machine 68 including the knives 17 comminutes tobacco at the rate at which the device 7 transfers tobacco from the duct 1 to the cutting station, i.e., into the range of orbiting knives 17.

The details of the speed regulator 48 are illustrated in FIG. 2. This regulator comprises three AND-gates 51, 52, 53. The inputs *a* and *b* of the AND-gate 51 are respectively connected to the outputs of two No-gates 54 and 56, and the inputs of the No-gates 54, 56 are respectively connected to the detectors 46 and 47. The inputs *a* and *b* of the AND-gate 52 are respectively connected to the detector 46 and the output of a third NO-gate 57. The input of the NO-gate 57 is connected to the lower detector 47. The inputs *a* and *b* of the AND-gate 53 are respectively connected to the detectors 46 and 47.

The outputs *c* of the AND-gates 51, 52 and 53 are respectively connected to the inputs of three rated value selectors 58, 59, 61. Each rated value selector may constitute an adjustable potentiometer. The selectors 58, 59, 61 are respectively set to cause the motor 9 to operate at a relatively high, an average or median, and a relatively low speed. The outputs of the selectors 58, 59, 61 are respectively connected to the corresponding inputs of three signal-comparing junctions 62, 63, 64. A second input of each of the junctions 62, 63, 64 receives signals from a revolution counter 66 which serves to monitor the speed of the motor 9. The outputs of the junctions 62, 63, 64 are connected with the corresponding inputs of a thyristorized amplifier 67 which constitutes an output element of the speed regulator 48 and serves to adjust the speed of the motor 9. The amplifier 67 preferably comprises a DC-output and may be identical with or analogous to the aforedescribed control circuit 39 for the variable-speed motor 32.

The operation is as follows:

The motor 32 drives the feeder 26 so that the carded belt 31 of the feeder draws from the bin 33 a continuous stream of tobacco leaves and delivers such leaves onto the upper reach of the belt 38*a*. The weighing device 38 weighs successive unit lengths of the tobacco stream and the transducer 41 transmits appropriate signals to the amplifier 43, 44 which adjust the speed of the motor 32 so that the rate at which the duct 1 receives a continuous stream of tobacco leaves is at least substantially constant.

The detectors 46 and 47 in or on the duct 1 insure that the cutting machine 68 can comminute tobacco at the rate which guarantees that the volume of tobacco in the duct remains within a predetermined range which is selected by the positioning of detectors 46 and 47. To this end, the detectors 46 and 47 cooperate with the speed regulator 48 as follows:

As long as the level of the upper surface of the supply of tobacco 2 in the duct 1 remains between the levels of the detectors 46 and 47, the amplifier 67 of the speed regulator 48 receives a signal from the junction 63 so that the motor 9 drives the chains 4, 6 and the carrier 18 at an average or median speed. The detector 46, whose light source is not covered by tobacco in the duct 1, transmits a signal to the NO-gate 54, to the input *a* of the AND-gate 52 and to the input *a* of the AND-gate 53. Consequently, the input *a* of the AND-gate 51 does not receive a signal because there is no signal at the output of the NO-gate 54. Tobacco in the duct 1 interrupts the light beam from the light source to the receiver of the lower detector 47; therefore, the detector 47 does not transmit signals to the NO-gate 56, to the NO-gate 57 and to the input *b* of the AND-gate 53. There is no signal at the output *c* of the AND-gate 51 and at the output *c* of the AND-gate 53. However, the output *c* of the AND-gate 52 transmits a signal to the rated value selector 59 because its input *a* receives a signal from the detector 46 and its input *b* receives a signal from the output of the NO-gate 57. The selector 59 transmits a signal to the associated junction 63 which also receives a signal from the revolution counter 66 and transmits a signal to the corresponding input of the amplifier 67 to insure that the motor 9 is driven at an average speed.

If the height of the supply or pile of tobacco 2 in the duct 1 increases so that the upper level of such supply reaches the detector 46, the detector 46 ceases to transmit signals to the NO-gate 54, to the input *a* of the AND-gate 52, and to the input *a* of the AND-gate 53. Consequently, the inputs *a* and *b* of the AND-gate 51 receive signals and the output *c* of this gate transmits a signal to the corresponding input of the rated value selector 58. The transmission of signals from the output *c* of the AND-gate 52 to the selector 59 is terminated and the AND-gate 53 does not transmit signals to the selector 61. The output of the selector 58 transmits a signal to the junction 62 which also receives a signal from the revolution counter 66. The signal from junction 62 to the corresponding input of the amplifier 67 causes the latter to increase the speed of the motor 9. Consequently, the height of the supply or pile of tobacco in the duct 1 begins to decrease, i.e., the upper level of such supply drops below the level of the light source and photosensitive receiver of the upper detector 46. Once the level of the tobacco has decreased below the level of the detector 46, the signal at the output *c* of the AND-gate 51 disappears and the AND-gate 52 begins to transmit signals to the associated rated value selector 59 so that the speed of the motor 9 is reduced to average speed.

If the upper level of the supply of tobacco in the duct 1 decreases to the level of the light source and photosensitive receiver of the lower detector 47, the AND-gate 52 ceases to transmit signals to the selector 59 but the output *c* of the AND-gate 53 begins to transmit signals to the selector 61 which transmits signals to the junction 64. The junction 64 further receives signals from the revolution counter 66 and reduces the speed of the motor 9 so that the quantity of tobacco in the duct 1 begins to increase. Once the upper level of tobacco supply in the duct 1 rises above the lower detector 47, the AND-gate 53 becomes deactivated and the output *c* of the AND-gate 52 begins to transmit signals to the selector 59 which causes the motor 9 to drive the chains 4, 6 and the carrier 18 at the average speed.

Figure 3:
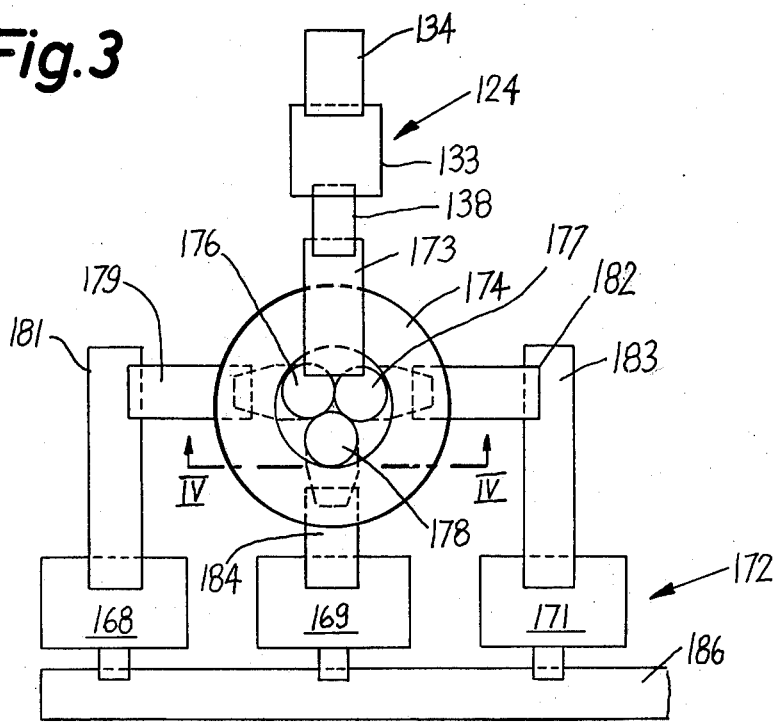
FIG. 3 is a schematic plan view of a modified apparatus which supplies tobacco to a battery of three cutting machines.

FIGS. 3 and 4 illustrate a modified apparatus wherein all such parts which are identical with or clearly analogous to the corresponding parts of the first apparatus are denoted by similar reference characters plus 100. The second apparatus supplies tobacco to three cutting machines 168, 169, 171 which together form a battery or group 172. All three cutting machines receive tobacco from a single metering unit 124 which is designed to furnish continuous streams of tobacco leaf laminae at a substantially constant rate. The weighing device 138 of the metering unit 124 receives tobacco from a bin 133 and delivers tobacco to a conveyor 173 which is preferably a vibrating trough. The bin 133 receives tobacco from a supply conveyor 134. The outlet of the conveyor 173 delivers tobacco into the open upper end of a funnel-shaped distributor or hopper 174. The lower portion of the distributor 174 has three outlets which respectively deliver tobacco streams to three discrete containers or ducts 176, 177, 178 serving to store intermediate supplies or piles of tobacco for transfer to the respective cutting machines 168, 171, 169. Each of the three ducts 176, 177, 178 normally receives equal quantities of tobacco. The outlet at the lower end of the duct 176 delivers tobacco to a first transfer device including a first vibrating trough 179 and a second vibrating trough 181, the latter serving to feed tobacco directly to the cutting station of the machine 168. The outlet of the duct 178 delivers tobacco to a second transfer device including a vibrating trough 184 which supplies tobacco to the cutting station of the machine 169. The transfer device between the outlet of the duct 177 and the cutting station of the machine 171 comprises two vibrating troughs 182 and 183. The cutting machines 168, 169, 171 deliver tobacco shreds to a common take-off conveyor 186.

The inlets of the ducts 176, 177, 178 can be sealed from the corresponding outlets of the distributor 174 by pivotable gates of flaps 187, 189 and 188. The gates 187, 188, 189 are respectively pivotable by servomotors 191, 193, 192 which receive signals from amplifiers 194, 197, 196. The inputs of the amplifiers 194, 197, 196 are respectively connected with revolution counters 198, 201, 199 which monitor the speed of variable-speed electric motors 202, 204, 203 for the knife carriers (not shown) of cutting machines 168, 169, 171 and for the respective transfer devices 179, 181 - 184 - 182, 183.

If the operation of one (e.g., 169) of the cutting machines 168, 169, 171 is interrupted (for example, due to a malfunction), the corresponding revolution counter 201 detects that the speed of the associated variable-speed motor 204 has been reduced to a predetermined minimum speed (zero) and transmits a signal to the associated amplifier 197. The amplifier 197 causes the servomotor 193 to close the corresponding gate 188 so that the duct 178 for the arrested cutting machine 169 does not receive tobacco from the distributor 174. Since the metering unit 124 continues to deliver tobacco at a constant rate, the distributor 174 delivers tobacco streams to the ducts 176, 177 at a higher rate which, in turn, causes the associated speed regulators (corresponding to the speed regulator 48 of FIG. 2) to increase the speed of the motors 202, 203 for the cutting machines 168, 171. Each of the motors 202, 203, 204 is controlled by a discrete speed regulator corresponding to the speed regulator 48 of FIG. 2, and the volume of tobacco in each of the ducts 176, 177, 178 is monitored by discrete detector means including one or more photoelectric cells or other suitable level indicators.

It is also within the scope of the invention to replace the detectors 46, 47 in each duct with a single detector or to utilize in each duct three or more detectors which are disposed at different levels. The corresponding speed regulator is then modified accordingly.

An important advantage of the improved method and apparatus is that the cutting machine 68 of FIG. 1 or the cutting machines 168, 169, 171 of FIG. 3 invariably comminute all of the tobacco leaves which are being transferred from the respective duct or ducts. Consequently, the volume of tobacco in the duct or ducts remains constant or fluctuates only within predetermined acceptable limits. This means that the dryer or dryers which are associated with the machine 68 or with the machines 168, 169, 171 invariably receive equal quantities of tobacco shreds per unit of time. At any rate, the improved method and apparatus invariably prevent long-range fluctuations of the quantity of tobacco which issues from the cutting machine or machines. Therefore, the construction and mode of operation of the dryers can be simplified because they must merely change the moisture content of admitted tobacco. The volume of tobacco in the duct or ducts will fluctuate for reasons which were outlined hereinbefore, such as the temperature of tobacco, the moisture content of tobacco and/or the size of material which is being supplied by the metering unit 24 or 124. The improved method and apparatus further insure that the volume of tobacco in the duct or ducts cannot increase to an extent which would necessitate recirculation of a certain amount of tobacco to the bin 33 or 133.

Without further analysis, the foregoing will so fully reveal the gist of the present invention that others can by applying current knowledge, readily adapt it for various applications without omitting features which fairly constitute essential characteristics of the generic and specific aspects of my contribution to the art and, therefore, such adaptations should and are intended to be comprehended within the meaning and range of equivalence of the claims.

What is claimed is:

1. A method of supplying tobacco to at least one cutting station wherein tobacco is comminuted at the rate at which it enters such station, comprising the steps of transporting a continuous stream of tobacco at a substantially constant rate along a predetermined path; accumulating the tobacco of such stream ahead of said station so that the thus accumulated tobacco forms an intermediate supply whose volume fluctuates for reasons other than variations in the rate of transport along said path, particularly as a result of variations in temperature, moisture content and/or size of tobacco forming said stream; transferring tobacco from said supply to said station at a variable rate; monitoring the volume of tobacco in said supply; and respectively increasing and reducing the rate of tobacco transfer from said supply to said station when the volume of tobacco forming said supply respectively increases and decreases so that the rate at which tobacco reaching said station is comminuted varies as a function of changes in the volume of tobacco forming said supply.

2. A method as defined in claim 1, wherein said intermediate supply consists of a pile of tobacco and said step of respectively increasing and reducing the rate of tobacco transfer comprises increasing the rate of tobacco transfer when the height of said pile reaches a predetermined upper level and reducing the rate of tobacco transfer when the height of said pile reaches a predetermined lower level.

3. A method as defined in claim 2, further comprising the step of transferring tobacco from said supply to said station at a substantially constant rate as long as the height of said pile remains between said levels.

4. A method as defined in claim 1 of supplying tabacco to said one station and to at least one additional cutting station wherein tobacco is comminuted at the rate at which it enters said additional station, further comprising the steps of transporting an additional continuous stream of tobacco at a substantially constant rate along an additional predetermined path, accumulating the tobacco of said additional stream ahead of said additional station so that the thus accumulated tobacco forms an additional intermediate supply whose volume fluctuates for reasons other than variations of the rate of transport along said additional path, particularly as a result of variations in temperature, moisture content and/or size of tobacco forming said additional stream, transferring tobacco from said additional supply to said additional station at a variable rate, monitoring the volume of tobacco in said additional supply, and respectively increasing and reducing the rate of tobacco transfer from said additional supply to said additional station when the volume of tobacco forming said additional supply respectively increases and decreases so that the rate at which tobacco reaching said additional station is comminuted varies as a function of changes in the volume of tobacco forming said additional supply.

5. A method as defined in claim 4, further comprising the steps of interrupting the comminuting of tobacco at said additional station, interrupting the transfer of tobacco to said additional supply and from said additional supply to said additional station, transporting said additional stream of tobacco to said first mentioned supply whereby the volume of tobacco forming said first mentioned supply increases, and increasing the rate of tobacco transfer from said first mentioned supply to said first mentioned station as a result of such increase in the volume of tobacco forming said first mentioned supply.

6. Apparatus for supplying tobacco to at least one tobacco cutting machine having variable-speed prime mover means whose speed determines the output of said machine, comprising a container arranged to store a supply of tobacco; a metering unit having means for feeding to said container a continuous stream of tobacco at a substantially constant rate; means for transferring tobacco from said container to said machine; regulating means operable to vary the speed of said prime mover means so that the speed of said prime mover means respectively increases and decreases when the volume of tobacco in said container respectively increases and decreases for reasons other than fluctuations in the rate of feed by said feeding means, particularly as a result of variations in temperature, moisture content and/or size of tobacco forming said stream; and means for operating said regulating means, including means for monitoring the volume of tobacco in said container.

7. Apparatus as defined in claim 6, wherein said transferring means comprises variable-speed conveyor means receiving motion from said prime mover means.

8. Apparatus as defined in claim 6, wherein said container is an upright duct and the tobacco of said supply forms a pile in said duct, said monitoring means including detector means arranged to monitor the height of said pile.

9. Apparatus as defined in claim 8, wherein said detector means includes an upper level indicator and a lower level indicator, said regulating means including an output element arranged to select for said prime mover means a relatively high first speed when the height of said pile increases to the level of said upper level indicator, a relatively low second speed when the height of said pile decreases to the level of said lower level indicator, and an average third speed which is less than said first speed but exceeds said second speed when the height of said pile is between the levels of said indicators.

10. Apparatus as defined in claim 9, wherein each of said indicators is a photoelectric cell having means for transmitting signals as long as the respective cell is above the pile in said container.

11. Apparatus as defined in claim 6 for supplying tobacco to said one machine and to at least one additional machine having additional variable-speed prime mover means whose speed determines the output of said additional machine, further comprising an additional container arranged to store an additional supply of tobacco, means for transferring tobacco from said additional supply to said additional machine, additional regulating means operable to vary the speed of said additional prime mover means so that the speed of said additional prime mover means respectively increases and decreases when the volume of tobacco in said additional container respectively increases and decreases for reasons other than fluctuations in the rate of feed of tobacco to said additional container, particularly as a result of variations in temperature, moisture content and/or size of tobacco which is fed to said additional container, and means for operating said additional regulating means including means for monitoring the volume of tobacco in said additional container, said metering unit further having means for feeding to said additional container an additional continuous stream of tobacco at a substantially constant rate.

12. Apparatus as defined in claim 11, wherein each of said transferring means comprises variable-speed conveyor means receiving motion from the respective prime mover means.

13. Apparatus as defined in claim 11, further comprising means for monitoring the speed of said prime mover means and means for interrupting the feed of tobacco to the respective container when the speed of one of said prime mover means reaches a predetermined minimum speed.

14. Apparatus as defined in claim 13, wherein said predetermined minimum speed is zero.

15. Apparatus as defined in claim 11, wherein said metering unit further comprises a distributor having a plurality of outlets, one for each of said containers, said outlets constituting said means for feeding said streams of tobacco to the respective containers.

* * * * *